US009205694B2

(12) United States Patent
Noe

(10) Patent No.: US 9,205,694 B2
(45) Date of Patent: Dec. 8, 2015

(54) WRISTBAND PAPER AND METHOD OF MANUFACTURING THE SAME

(76) Inventor: Kyung-il Noe, Seoul (KR)

( * ) Notice: Subject to any disclaimer, the term of this patent is extended or adjusted under 35 U.S.C. 154(b) by 11 days.

(21) Appl. No.: 14/353,093

(22) PCT Filed: Mar. 9, 2012

(86) PCT No.: PCT/KR2012/001748

§ 371 (c)(1),
(2), (4) Date: Apr. 21, 2014

(87) PCT Pub. No.: WO2013/089318

PCT Pub. Date: Jun. 20, 2013

(65) Prior Publication Data

US 2014/0302260 A1 Oct. 9, 2014

(30) Foreign Application Priority Data

Dec. 14, 2011 (KR) ..... 10-2011-0134350

(51) Int. Cl.

| | |
|---|---|
| ***B41M 5/50*** | (2006.01) |
| ***B41M 5/52*** | (2006.01) |
| ***A44C 5/00*** | (2006.01) |
| ***G09F 3/00*** | (2006.01) |
| ***B05D 7/00*** | (2006.01) |

(52) U.S. Cl.

CPC ..... *B41M 5/50* (2013.01); *A44C 5/0015* (2013.01); *B05D 7/56* (2013.01); *B41M 5/502* (2013.01); *B41M 5/504* (2013.01); *B41M 5/529* (2013.01); *B41M 5/5254* (2013.01); *G09F 3/005* (2013.01)

(58) Field of Classification Search

CPC ..... B41M 5/50; B41M 5/502; B41M 5/504; B41M 5/5254; B41M 5/529; A44C 5/00; A44C 5/0015; G09F 4/00; G09F 4/005; G09F 3/00; G09F 3/005

USPC ..... 428/32.28, 32.34, 32.38

See application file for complete search history.

(56) References Cited

U.S. PATENT DOCUMENTS

| | | | | |
|---|---|---|---|---|
| 6,951,683 | B2 | 10/2005 | Blackwell | |
| 2003/0035944 | A1 | 2/2003 | Blackwell | |
| 2009/0286033 | A1 | 11/2009 | Taghavi et al. | |
| 2013/0145663 | A1 * | 6/2013 | Greer | G09F 3/02 40/633 |

FOREIGN PATENT DOCUMENTS

| | | |
|---|---|---|
| JP | 2000160111 | 6/2000 |
| JP | 2002019272 | 1/2002 |
| KR | 1020100113014 | 10/2010 |

OTHER PUBLICATIONS

International Search Report—PCT/KR2012/001748 dated Nov. 21, 2012.

* cited by examiner

*Primary Examiner* — Bruce H Hess
(74) *Attorney, Agent, or Firm* — Cantor Colburn LLP

(57) ABSTRACT

A wristband paper includes an ink-receiving layer formed on the upper side of the paper to be printed with ink, an adhesion layer and a separating layer for protecting the adhesion layer, which are formed on the lower side of the paper, wherein the ink-receiving layer is formed by applying a solution including polyethylene, polyvinyl alcohol and silica and then drying the solution. The wristband paper can be easily made into a wristband directly using a general printer.

2 Claims, 3 Drawing Sheets

WRISTBAND PAPER AND METHOD OF MANUFACTURING THE SAME

BACKGROUND OF THE INVENTION

1. Field of the Invention

The present invention relates to a wristband paper and a method of manufacturing the same. More particularly, the present invention relates to a wristband paper, which can be printed by a general printer because it includes an ink-receiving layer, and to a method of manufacturing the same.

2. Description of the Prior Art

A wristband is worn at the time of entering an amusement park or the like, thus enabling a person to conveniently use the amusement park or the like. Such a wristband is frequently used in various kinds of exhibitions, meetings, etc. as well as amusement parks. Currently, with the increase in demand for a wristband, a market requiring a small number of wristbands having various designs as well as a market requiring a large number of wristbands having one design is being formed.

However, a conventional wristband could be printed only by UV printing. Briefly explaining, UV printing is a method of printing a wristband with UV ink and then irradiating the printed wristband with UV light to instantly dry the wristband. Therefore, when a small number of wristbands are manufactured by UV printing, there are many troubles.

Therefore, it is required to develop a wristband paper, which can be easily made into a wristband directly using a general-purpose printer.

SUMMARY OF THE INVENTION

Accordingly, the present invention has been made to solve the above-mentioned problems, and an object of the present invention is to provide a wristband paper, which can be easily made into a wristband directly using a general-purpose printer.

An aspect of the present invention provides a wristband paper, including: an ink-receiving layer formed on the upper side of the paper to be printed with ink; and an adhesion layer and a separating layer for protecting the adhesion layer, which are formed on the lower side of the paper.

The wristband paper may be provided thereon with cut lines at regular intervals.

Specifically, the ink-receiving layer may be formed by applying a solution including polyethylene, polyvinyl alcohol and silica and then drying the solution. The solution may include 70 wt % to 90 wt % of polyethylene. The solution may further include dimethyl, methyl(polyethylene oxide) silicone.

Another aspect of the present invention provides method of manufacturing a wristband paper, including the steps of: (a) applying a solution for forming an ink-receiving layer to be printed with ink onto the upper side of the paper; (b) drying the solution for forming the ink-receiving layer; and (c) forming cut lines on the paper at regular intervals.

The wristband paper according to an embodiment of the present invention can be easily made into a wristband directly using a general-purpose printer.

Figure 1A:
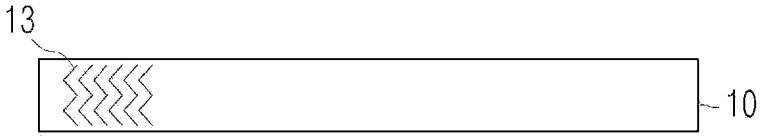
Fig.1A Prior Art
FIG. 1A is a plan view of a general wristband.

| <Description of the Reference Numerals in the Drawings> | |
|---|---|
| 10: conventional wristband | 11: adhesion layer |
| 12: separating layer | 13: knife line |
| 100: wristband paper according to an embodiment of the present invention | |
| 20: wristband according to an embodiment of the present invention | |
| 21: ink-receiving layer | 22: adhesion layer |
| 23: separating layer | 24: knife line |
| 25: cut line | |

DETAILED DESCRIPTION OF THE EXEMPLARY EMBODIMENTS

Hereinafter, preferred embodiments of the present invention will be described in detail with reference to the accompanying drawings.

The present invention may be embodied in many different forms without departing from the spirit and significant characteristics of the invention. Therefore, the embodiments of the present invention are disclosed only for illustrative purposes and should not be construed as limiting the present invention.

Figure 1B:
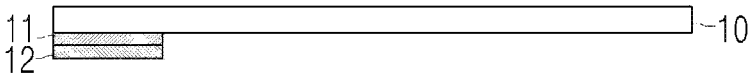
Fig.1B Prior Art
FIG. 1B is a sectional view thereof.

First, FIG. 1A is a plan view of a general wristband 10, and FIG. 1B is a sectional view thereof. As shown in FIGS. 1A and 1B, the general wristband 10 has predetermined length and width, and is provided on one end thereof with an adhesion layer 11 attached and connected to the other end of the wristband and a separating layer 12 for protecting the adhesion layer 11. When the separating layer 12 is removed from the wristband 10, the adhesive surface of the adhesion layer 11 is exposed to the outside.

Further, the adhesion layer is provided with knife lines to limit the wristband 10 as a disposable wristband, thus serving to prevent the wristband 10 from being reused after one end of the wristband 10 is attached to the other end thereof and then detached there from.

This wristband 10 may be printed with various designs. However, this wristband 10 cannot be printed by a general ink-jet printer because of material characteristics of Tyvek paper generally used in conventional wristbands. For reference, Tyvek, which is made of high-density polyethylene fiber, is the brand name of products having all the characteristics of paper, film and fabric, and is the term defining such products. That is, since only UV printing can be used in printing Tyvek paper, it is inconvenient and cumbersome to print this Tyvek paper.

Figure 2:
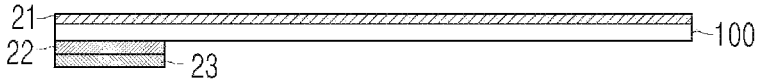
FIG. 2 is a sectional view of a wristband paper according to an embodiment of the present invention.

FIG. 2 is a sectional view of a wristband paper 100 according to an embodiment of the present invention. As shown in FIG. 2, the wristband paper 100 according to an embodiment of the present invention includes: an ink-receiving layer 21 formed on the upper side of the paper 100; an adhesion layer 22 and a separating layer 23 for protecting the adhesion layer 22, which are formed on the lower side of the paper 100. Here, the ink-receiving layer 21 means a layer enabling a conventional non-printable wristband paper to be printed with ink and/or a layer capable of absorbing ink.

Figure 3:
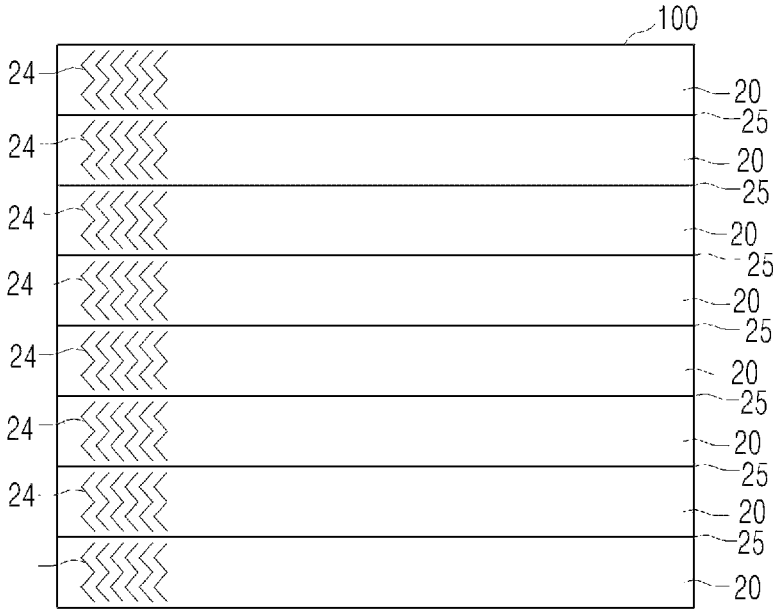
FIG. 3 is a plan view of the wristband paper according to an embodiment of the present invention.
Figure 4:
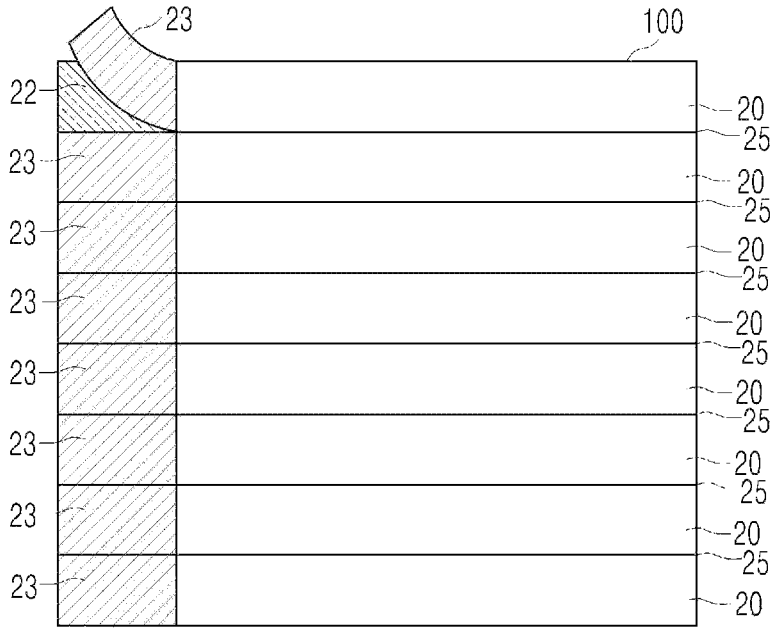
FIG. 4 is a bottom view of the wristband paper according to an embodiment of the present invention.

FIG. 3 is a plan view of the wristband paper 100 according to an embodiment of the present invention, and FIG. 4 is a bottom view thereof.

As shown in FIG. 3, the wristband paper 100 according to an embodiment of the present invention is provided with cut lines 25 at regular intervals, and thus wristbands 20 divided by the cut lines 25 can be separated from the wristband paper 100 one by one. Meanwhile, each of the wristbands 20 divided by the cut lines 25 is provided on one end thereof with knife lines 24.

Further, as shown in FIG. 4, the lower side of the wristband paper 100, corresponding to the upper side thereof provided with cut lines 25, is provided with an adhesion layer 22 and a separating layer 23 for protecting the adhesion layer 22. The separating layer 23 is separated from the adhesion layer 22, and one end of the wristband 20 is attached to the other end thereof, thereby allowing the wristband 20 to function as a wristband.

Specifically, the ink-receiving layer 21 formed on one side of the paper 100 may be formed by applying a solution including polyethylene, polyvinyl alcohol and silica and then drying the solution. That is, a roller type applicator is coated with the solution, the solution is applied onto the paper 100 by the rotation of the applicator, and then the solution is dried by a dryer, thereby completing the ink-receiving layer 21. Particularly, in the present invention, it is preferred that polyethylene extracted from natural fiber be used.

In the solution for forming the ink-receiving layer 21, polyethylene may be included in an amount of 70 wt % to 90 wt %, polyvinyl alcohol may be include in an amount of 5 wt % to 20 wt %, and silica may be include in an amount of 3 wt % to 10 wt %. The solution may further include dimethyl, methyl(polyethylene oxide) silicone.

Figure 5:
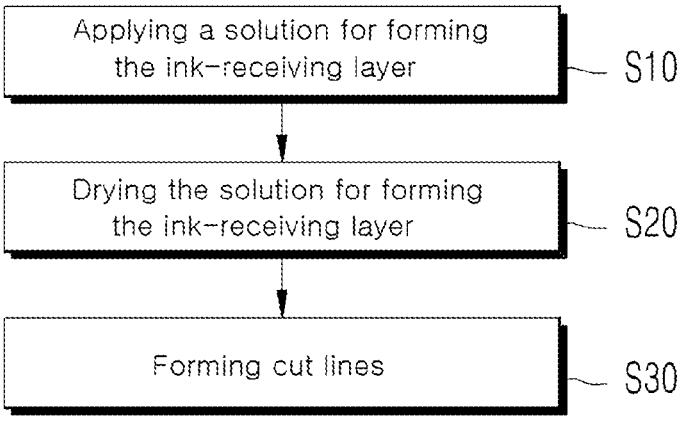
FIG. 5 is a flow diagram showing a method of manufacturing the wristband paper according to an embodiment of the present invention.

FIG. 5 is a flow diagram showing a method of manufacturing the wristband paper 100 according to an embodiment of the present invention. As shown in FIG. 5, the method of manufacturing the wristband paper 100 according to an embodiment of the present invention includes the steps of: (S10) applying a solution for forming the ink-receiving layer 21 onto the upper side the paper 100; (S20) drying the solution for forming the ink-receiving layer 21; and (S30) forming cut lines on the paper 100 at regular intervals.

The method of manufacturing a wristband paper 100 according to an embodiment of the present invention may further include the steps of: (S40) forming knife lines 24 for preventing the reuse of the wristband 20; and (S50) forming the adhesive layer 22 and the separating layer 23 on the lower side of the paper 100. The adhesion layer 22 and the separating layer 23 may be simply formed by removing one side of a double-sided adhesive tape and attaching it to the paper and leaving the other side thereof.

As describe above, according to the ink-receiving layer 21 of an embodiment of the present invention, even when this ink-receiving layer 21 adheres to the wristband paper, the color of the wristband paper is not changed, and this wristband paper is excellent in image quality compared to when a general paper is printed by an inkjet printer. That is, the wristband paper maintains the characteristics of Tyvek paper, and simultaneously can be printed by an inkjet printer, thus requiring no additional equipment, facility and work.

Consequently, the wristband paper 100 according to an embodiment of the present invention can be simply printed by an ink-jet printer generally used in offices or home, and can be divided into a plurality of wristbands 20 by the cut lines 25.

The wristband paper according to an embodiment of the present invention can be easily made into a wristband directly using a general printer.

What is claimed is:

1. A method of manufacturing a wristband paper, comprising the steps of:

(a) applying a solution for forming an ink-receiving layer to be printed with ink onto an upper side of the paper, wherein the solution for forming the ink-receiving layer includes polyethylene, polyvinyl alcohol, silica and dimethyl, methyl(polyethylene oxide) silicone; and;

(b) drying the solution for forming the ink-receiving layer.

2. The method of claim 1, further comprising: (c) forming cut lines on the paper at regular intervals.

* * * * *